US005435245A

United States Patent [19]

Salisbury et al.

[11] Patent Number: 5,435,245

[45] Date of Patent: Jul. 25, 1995

[54] SELF-INKING ROLLER STAMP

[75] Inventors: Thomas E. Salisbury, Wayland; Robert A. Cann, Amherst; Robert C. Gorin, Newton Center; David E. Boundy, Billerica, all of Mass.

[73] Assignee: Radix Limited, Wayland, Mass.

[21] Appl. No.: 260,665

[22] Filed: Jun. 16, 1994

Related U.S. Application Data

[60] Continuation of Ser. No. 183,569, Jan. 19, 1994, abandoned, which is a continuation of Ser. No. 139,276, Oct. 18, 1993, abandoned, which is a division of Ser. No. 940,067, Sep. 3, 1992, abandoned.

[51] Int. Cl.[6] ..... B41F 5/00

[52] U.S. Cl. ..... 101/328; 101/405; 401/208

[58] Field of Search ..... 101/328, 329, 327, 333, 101/368, 405, 406, 111; 401/208, 196, 197, 198

[56] References Cited

U.S. PATENT DOCUMENTS

| | | | |
|---|---|---|---|
| D. 266,257 | 9/1982 | Ahrens | D18/15 |
| D. 272,364 | 1/1984 | Matsumuro | D18/16 |
| D. 318,685 | 6/1991 | Kida | D19/71 |
| D. 339,819 | 9/1993 | chen | D18/14 |
| 637,832 | 11/1899 | Rosenberg | 401/208 |
| 840,413 | 1/1907 | Alexander et al. . | |
| 1,127,806 | 2/1915 | Pells et al. | 101/328 |
| 2,299,242 | 10/1942 | Lui . | |
| 2,570,243 | 10/1951 | Johnson | 401/208 |
| 2,573,201 | 10/1951 | Kelley et al. | 401/208 |
| 2,819,664 | 1/1958 | Elton | 95/31 |
| 2,995,083 | 8/1961 | Wright | 401/219 |
| 3,006,273 | 10/1961 | Sommer | 101/328 |
| 3,158,096 | 11/1964 | Arnold | 101/368 |
| 3,251,299 | 5/1966 | Duke et al. | 101/368 |
| 3,374,050 | 3/1968 | Rabin et al. | 401/208 |
| 3,427,115 | 2/1969 | Jolly | 401/208 |
| 3,465,673 | 9/1969 | Oppenheim . | |
| 3,481,675 | 12/1969 | Greenberg | 401/208 |
| 3,577,918 | 5/1971 | Wayfield | 101/328 |
| 3,646,885 | 3/1972 | Kolody | 101/328 |
| 3,747,232 | 7/1973 | Donaldson et al. | 101/333 |
| 3,797,390 | 3/1974 | Marozzi et al. | 101/333 |
| 3,955,499 | 5/1976 | Funahashi . | |
| 4,289,070 | 9/1981 | MacGregor | 101/327 |
| 4,321,868 | 3/1982 | Kikuchi . | |
| 4,362,101 | 12/1982 | Ahrens | 101/327 |
| 4,561,353 | 12/1985 | Chapman et al. . | |
| 4,593,618 | 6/1986 | Lebensfeld . | |
| 4,817,526 | 4/1989 | Winston | 101/329 |
| 4,823,691 | 4/1989 | Müller . | |
| 4,986,175 | 1/1991 | Boehringer et al. | 101/125 |
| 4,993,159 | 2/1991 | Hull et al. . | |
| 4,998,473 | 3/1991 | Laureyns | 101/333 |
| 5,022,323 | 6/1991 | Schultheis . | |
| 5,115,729 | 5/1992 | Beckman et al. | 101/327 |

FOREIGN PATENT DOCUMENTS

| | | | |
|---|---|---|---|
| 0144207 | 11/1984 | European Pat. Off. . | |
| 2384627 | 3/1977 | France . | |
| 2437061A1 | 2/1976 | Germany . | |
| 3233431A1 | 3/1984 | Germany . | |
| 3610326A1 | 10/1986 | Germany . | |
| 3738186 | 5/1989 | Germany . | |
| 2197821 | 2/1988 | United Kingdom | B41K 1/02 |

OTHER PUBLICATIONS

Clearsnap, Inc. brochure, "Marking Industry Update", 4 pages, Oct. 1991.

Craft Master, "I Scent A Letter TM" advertisement, 1985.

Roller Marker Sketch (undated).

*Primary Examiner*—Eugene H. Eickholt

*Attorney, Agent, or Firm*—Fish & Richardson

[57] ABSTRACT

A hand-held roller stamp that includes a wheel with a raised printing surface, and a housing that holds the wheel and permits it to rotate; the housing is configured to hold a porous-point marker with its nib positioned to continuously ink the printing surface.

22 Claims, 9 Drawing Sheets

SELF-INKING ROLLER STAMP

This is a continuation of application Ser. No. 08/183,569, filed Jan. 19, 1994, now abandoned, which was a continuation of Ser. No. 08/139,276, filed Oct. 18, 1993, now abandoned, which was a Divisional of Ser. No. 07/940,067, filed Sep. 3, 1992, now abandoned in favor of Ser. No. 08/238,971, filed May 5, 1994, now pending.

BACKGROUND OF THE INVENTION

This invention relates to self-inking roller stamps.

Printing by applying ink to a raised printing surface and then pressing the inked surface to paper or another surface has been known for centuries. The printing surface is usually re-inked between impressions. A familiar way of re-inking is to incorporate an ink pad in a hand stamp and provide a mechanism for moving the printing surface back and forth from the ink pad to the paper. Or, the printing surface and its substrate can be made of microporous material, with the ink passing through to the printing surface from a backing reservoir. These methods are best suited to printing a single non-repeating pattern.

A continuous and repeating graphic can be printed by a printing surface arranged on a roller and inked by rolling the roller across an ink pad.

SUMMARY OF THE INVENTION

In embodiments of the invention, a porous-point marker is attached to a housing of a roller stamp so that the printing surface can be automatically and continuously inked using a readily available, non-messy, replaceable ink supply.

Thus, in general, in one aspect, the invention features a hand-held roller stamp that includes a wheel with a raised printing surface, and a housing that holds the wheel and permits it to rotate; the housing is configured to hold a porous-point marker with its nib positioned to continuously ink the printing surface; the marker has a capping crown and the housing has a sleeve to hold the capping crown.

Embodiments of the invention include the following features. There are crush ribs projecting from an inner surface of the sleeve. The capping crown and the sleeve have mating features (contours) for interlocking the capping crown to the sleeve.

In general, in another aspect of the invention, the marker is held with a broad dimension of the marking surface of the nib parallel to the axis of the wheel (and, e.g., in a plane tangent to a circle defined by the printing surface).

In general, in another aspect of the invention, the housing has a guideway with a slot that holds the nib in position. In embodiments, the slot has a cross-section no more than slightly larger than the nib.

In general, in another aspect of the invention, the housing has cavities to hold the axle, and the cavities are configured to allow the wheel to move toward or away from the nib. In embodiments, the rim of the wheel has an edge configured to support the wheel in the housing, and the housing covers at least half of the rim. The printing surface may be configured to print a self-meeting repeating graphic.

In another aspect, the invention features a hand-held stamp for printing on a surface. The stamp has an endless substrate having a raised printing surface, and a mechanism for allowing the substrate to rotate as the printing surface is rolled across the surface, while the printing surface is simultaneously inked from two or more porous markers held to ink a printing surface wider than the nib of one of the markers.

Embodiments of the invention include the following features. The substrate may be a flexible belt. A cap provides an airtight seal of the marker. A case is configured to hold the stamp and provide an airtight seal of the marker.

A user of the stamp can easily apply a continuous and repeating graphic pattern to a paper or other surface. The ink is supplied by a conventional porous-point marker, an inexpensive and clean source of ink. The graphic pattern can be printed continuously until the marker runs dry. The printing surface can be as wide as the broad dimension of the marking surface of the nib of the marker. The invention compensates for variability in the positioning of the marker in the stamp, dimensions of the nib, nib wear, or diameter of the printing surface. The repeating pattern can be any lettering or graphic design. The printing surface can be arranged to "meet itself," allowing the roller stamp to print a seamlessly repeating graphic, or can be used to print a non-repeating graphic many times where such repetition is desired to ensure readability.

Other advantages and features will be apparent from the following description, and from the claims.

DESCRIPTION

Figure 6:
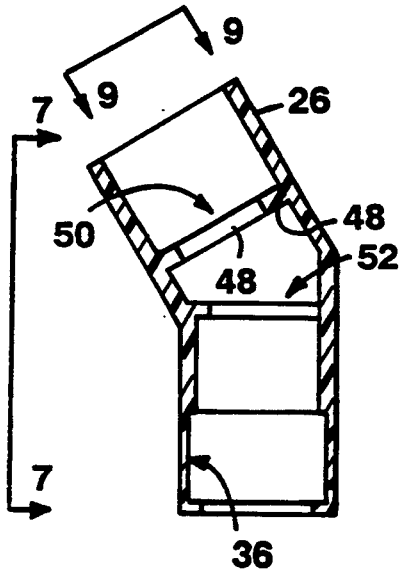
Figure 7:
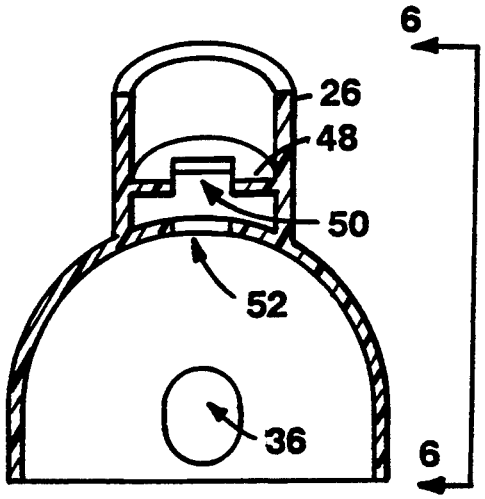
Figure 8:
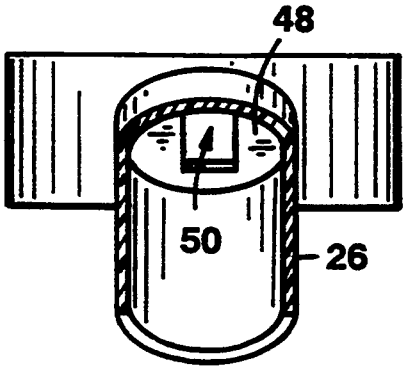

FIGS. 6, 7, and 8 are side and end sectional views, and top cutaway view of the housing of the roller stamp.

Figure 9:
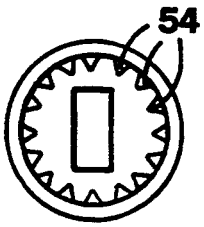

FIG. 9 is an end view of another embodiment.

Figure 10:
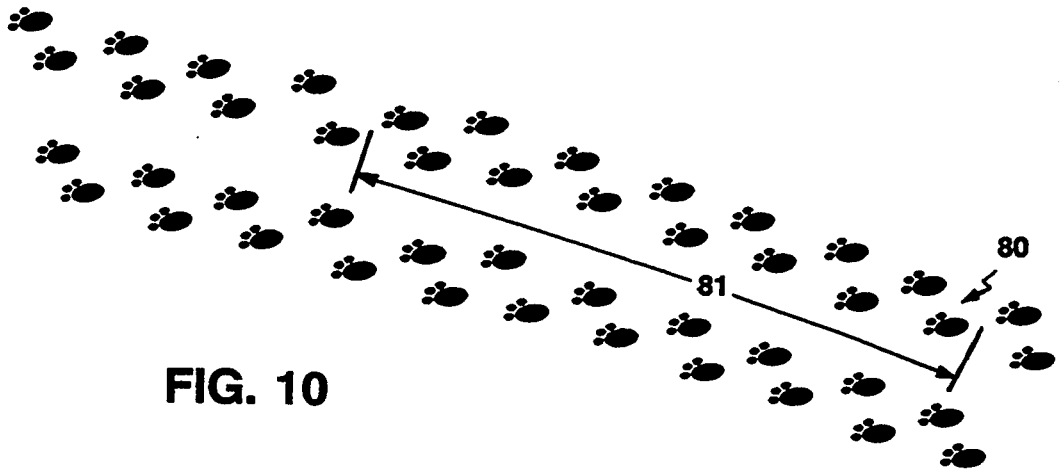
Figure 11:
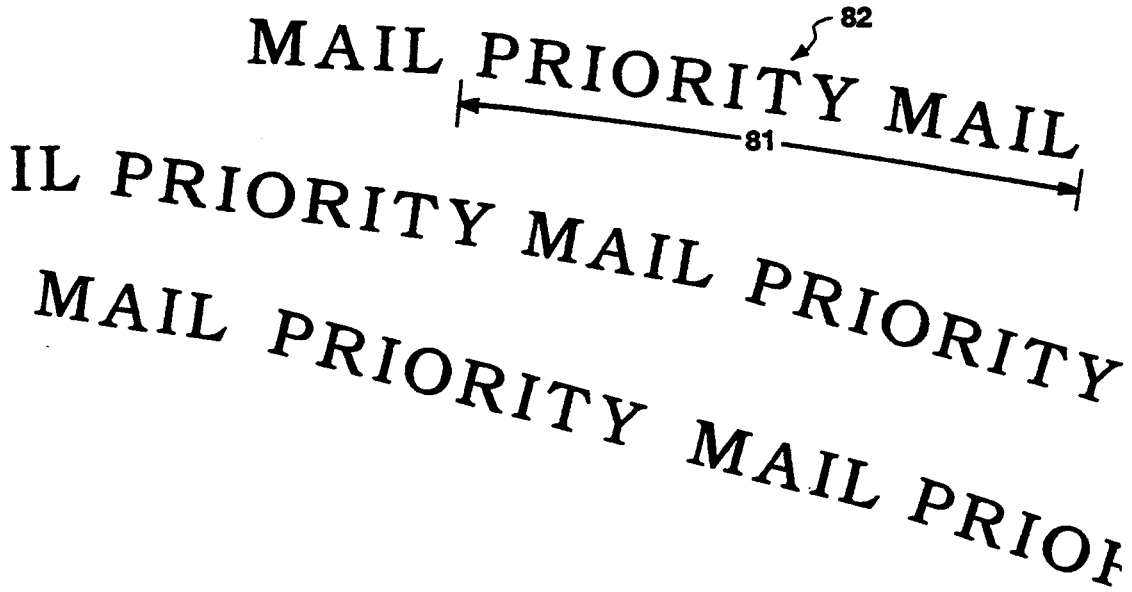

FIGS. 10 and 11 show impressions made by roller stamps.

Figure 12:
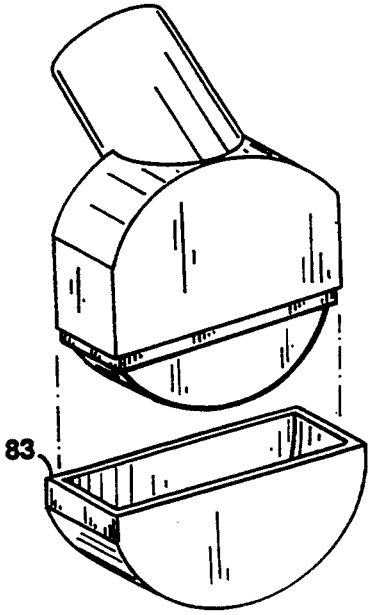

FIG. 12 is a perspective view of a roller stamp and cap.

Figure 13:
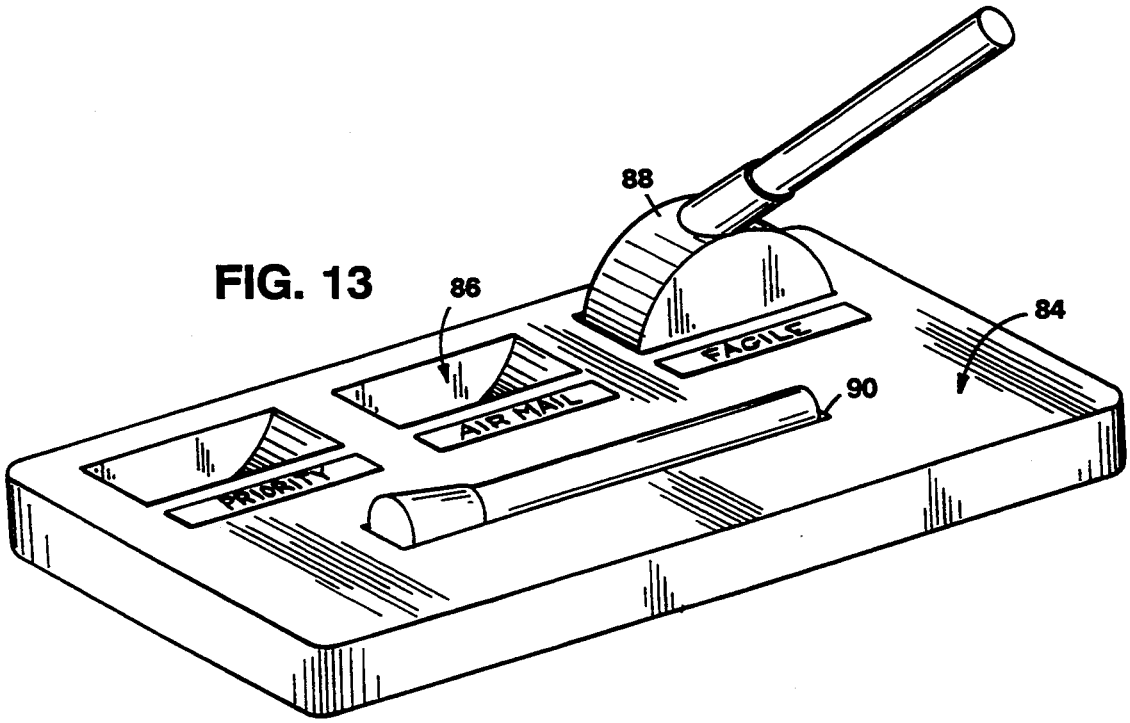

FIG. 13 is a perspective view of a storage case for a kit of roller stamps and markers.

Figure 14:
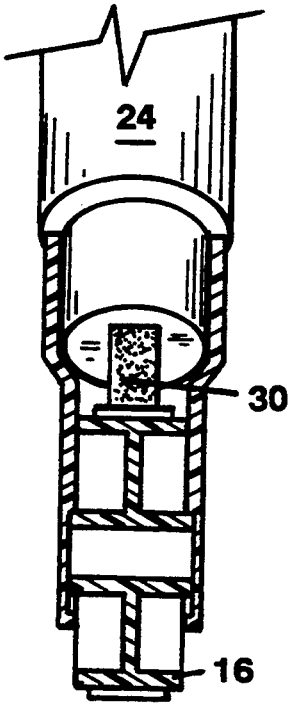
Figure 15:
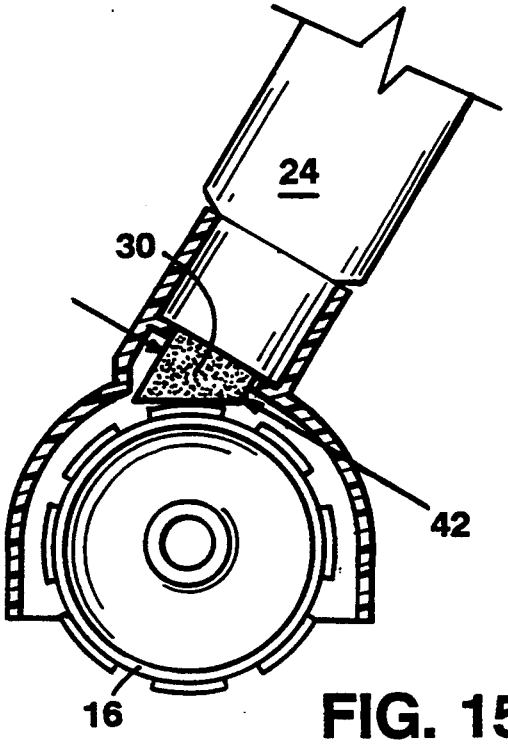

FIGS. 14 and 15 are side and end cutaway views of another roller stamp.

Figure 16:
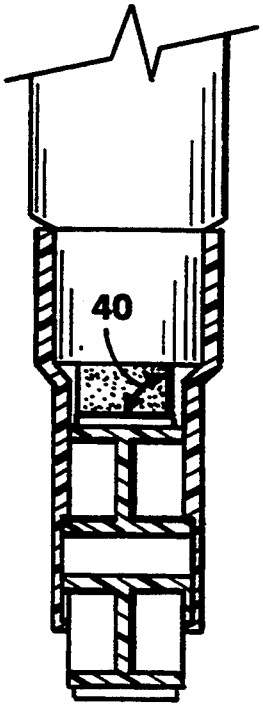
Figure 17:
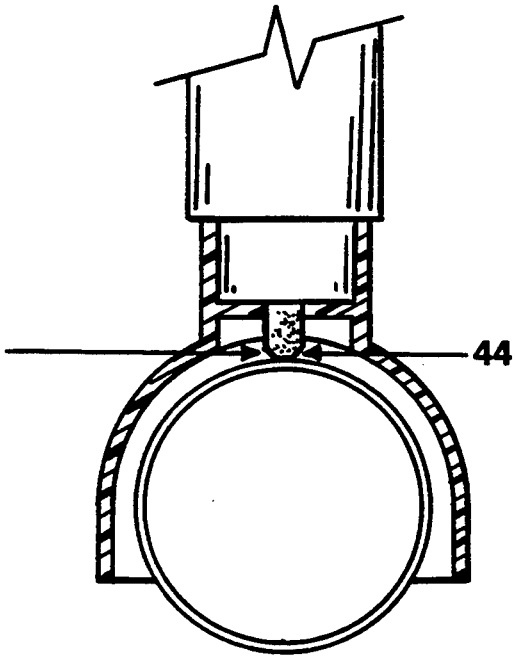

FIGS. 16 and 17 are cutaway side views of other roller stamps.

Figure 18:
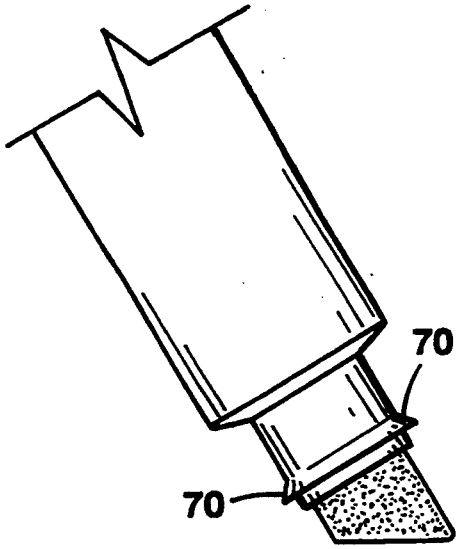
Figure 19:
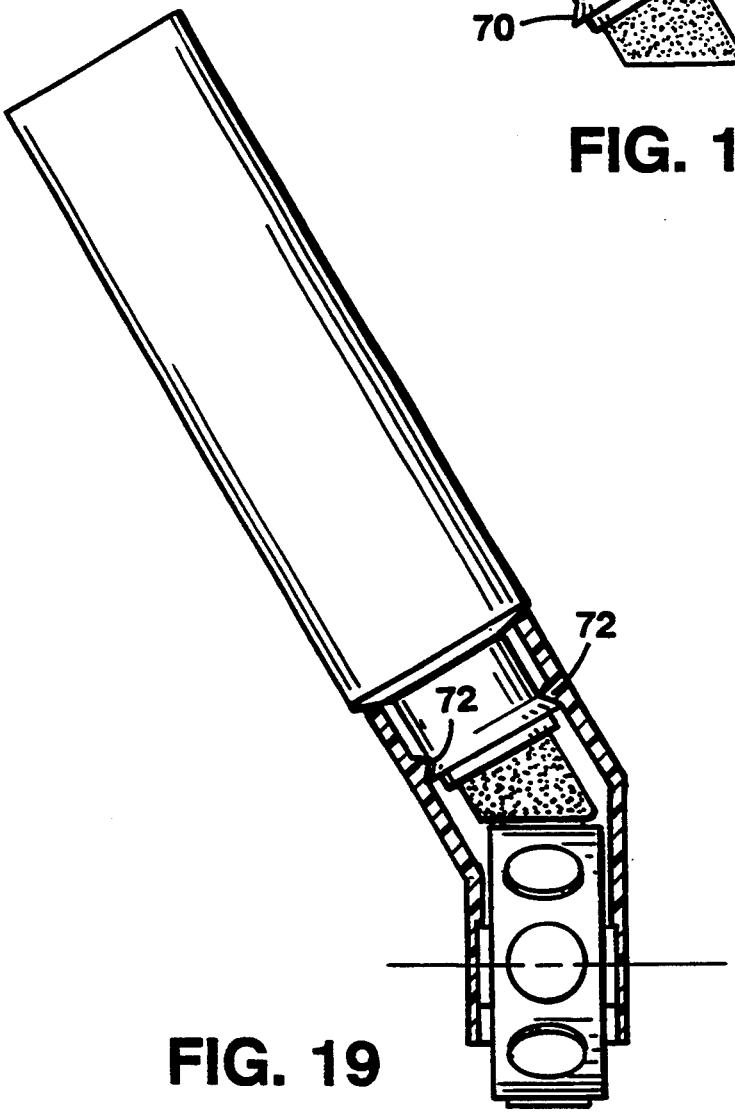

FIGS. 18 and 19 are side views of a special marker and a roller stamp.

Figure 20:
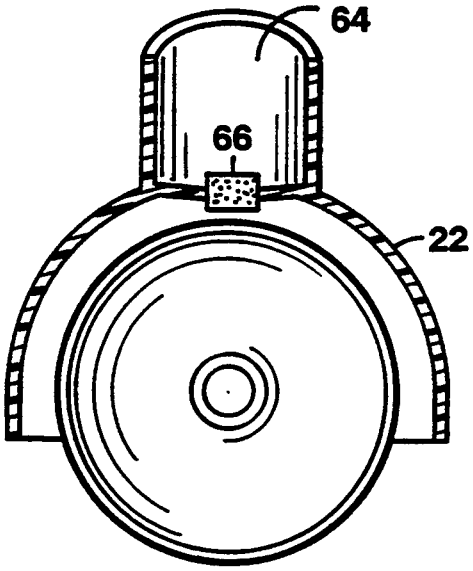
Figure 21:
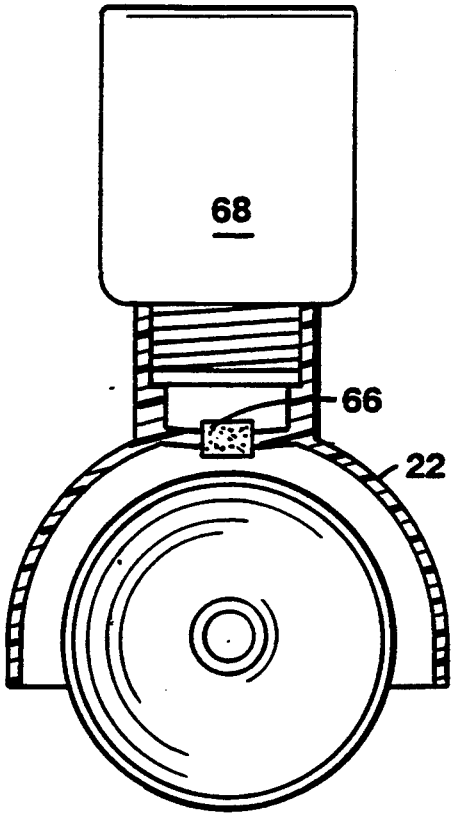

FIGS. 20 and 21 are cutaway views of roller stamps with ink reservoirs.

Figure 22:
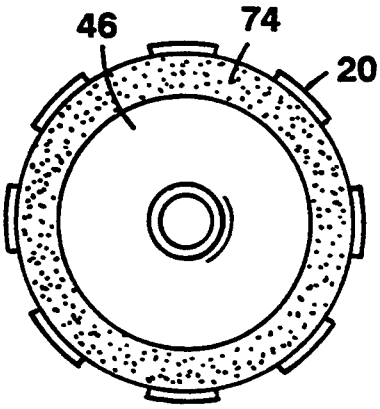
Figure 23:
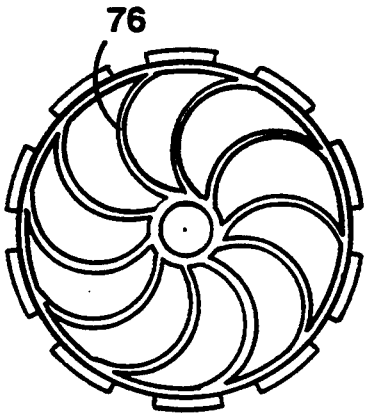

FIGS. 22 and 23 are side views of modified wheels.

Figure 24:
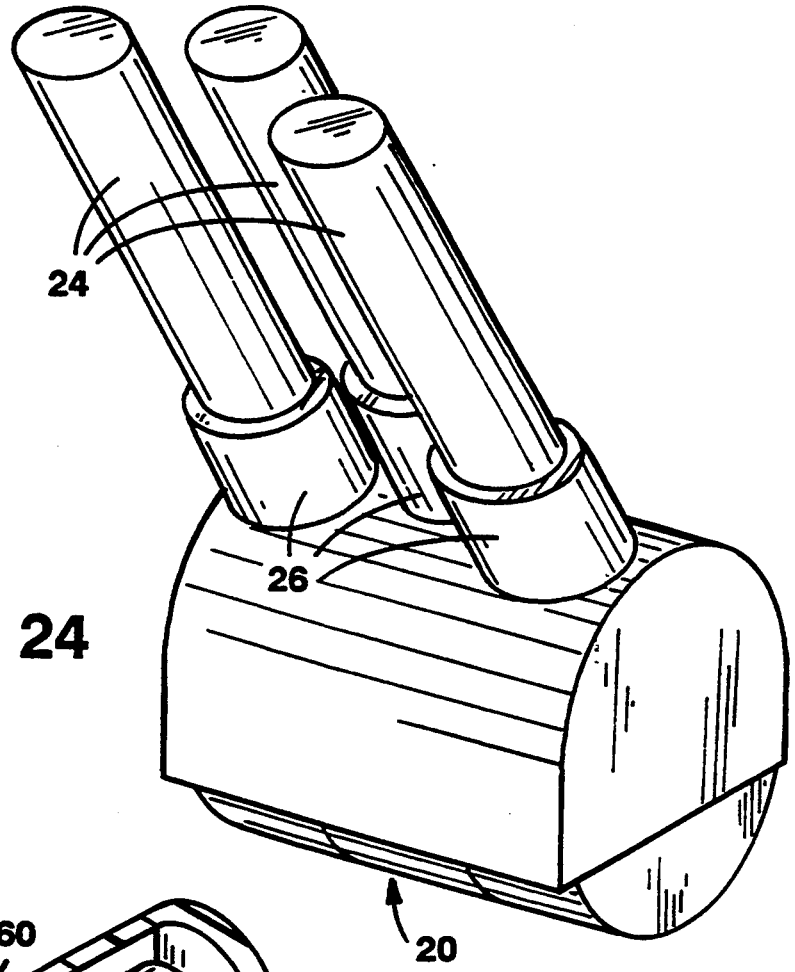

FIG. 24 is a perspective view of another roller stamp using three markers as the ink source.

Figure 25:
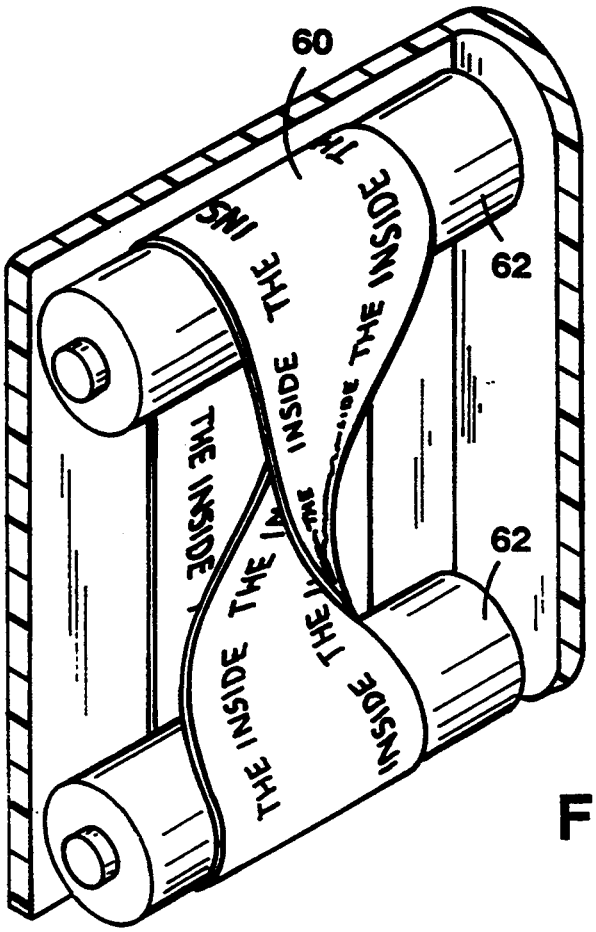

FIG. 25 is a perspective cutaway view of a stamp with its printing surface raised on a belt.

Figure 1:
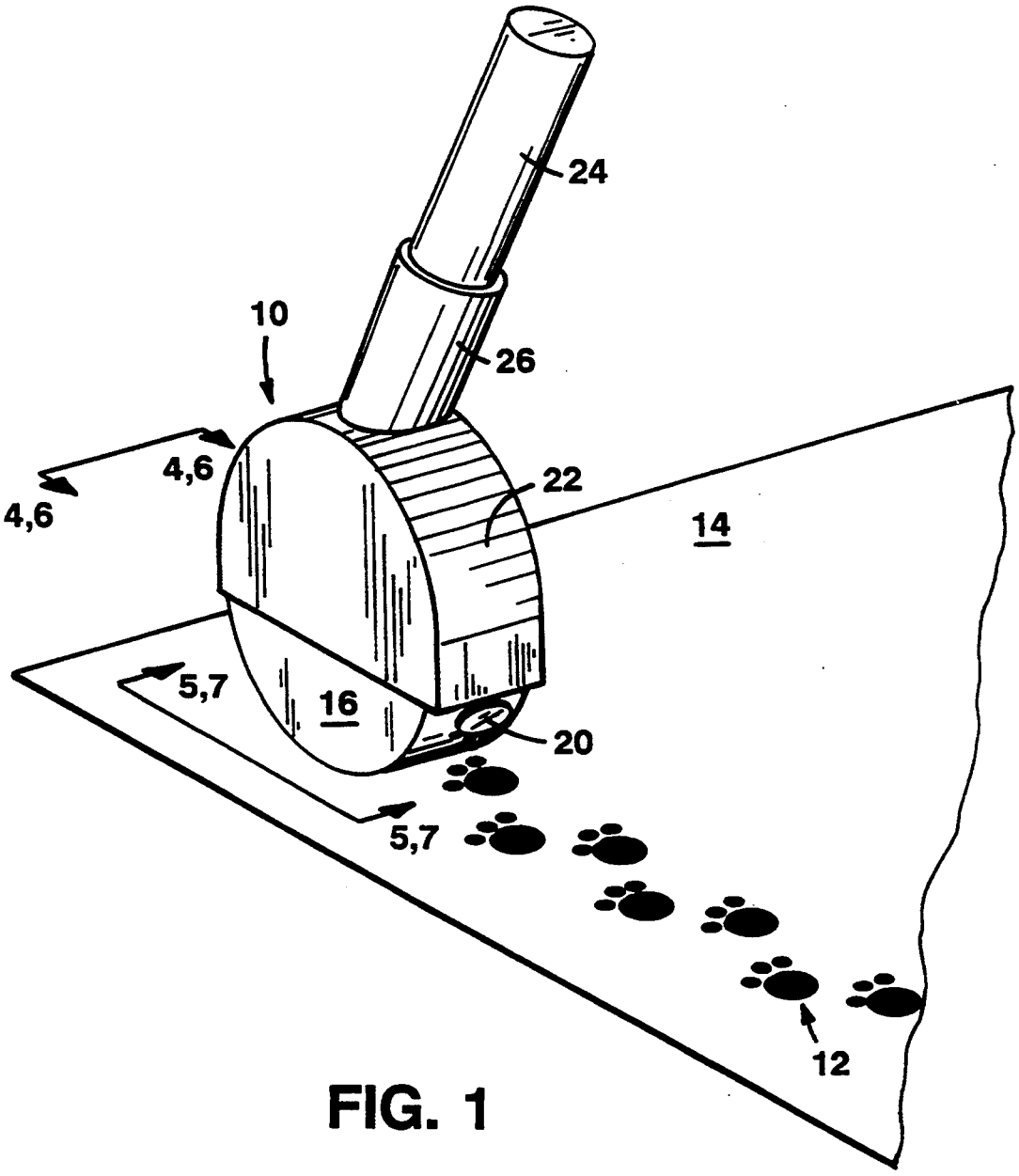
FIG. 1 is a perspective view of a roller stamp in use.

The roller stamp 10 of FIG. 1 allows a user to easily apply a continuous and repeating graphic pattern 12 to a paper surface 14. Stamp 10 has a wheel 16 which carries on its rim a printing surface 20, i.e., a relief impression of the mirror-image of a desired lettering or graphic design. A molded plastic housing 22 has a cylindrical sleeve 26 to hold a cylindrical porous-point marker 24. The sleeve holds the marker with its nib (not visible in FIG. 1) in continuous contact with the printing surface 20 as the wheel rotates, so the marker serves as the ink source for the printing surface. The graphic pattern can be printed continuously until the marker runs dry.

Figure 2:
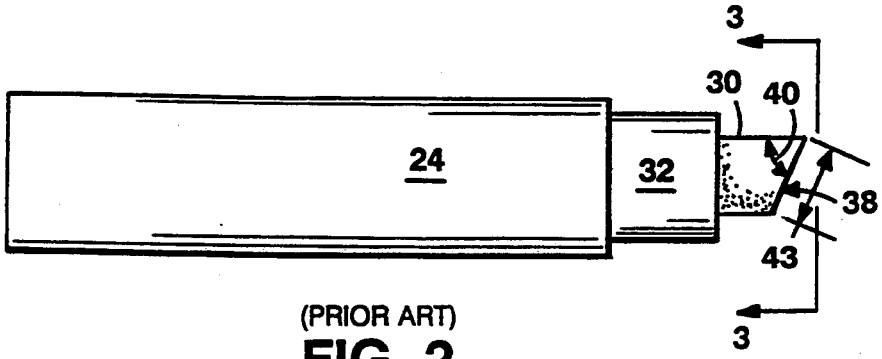
(PRIOR ART) FIG. 2
FIGS. 2 and 3 are side and end views of a porous-point marker.
Figure 3:
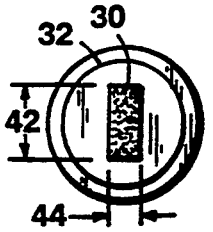
(PRIOR ART) FIG. 3

Referring to FIGS. 2 and 3, a marker suitable for use with the roller stamp has a nib 30 and a usually-cylindrical capping crown or ferrule 32. The nib is characterized by a major dimension 42 and a minor dimension 44, and by a nib angle 40. The nib has a marking surface 38. The major dimension 42 and nib angle 40 determine a broad dimension 43. The various dimensions of the roller stamp are tailored to the capping crown diameter and nib configuration of the marker being used, for example the Markmaster marker available from Dennison which has capping crown diameter 0.85", major dimension 0.6", minor dimension 0.3", and nib angle 30 degrees.

The housing holds the marker more or less rigidly in its correct orientation, and holds the wheel so that it rotates stably around its axis and rotates the printing surface against the nib of the marker.

Figure 4:
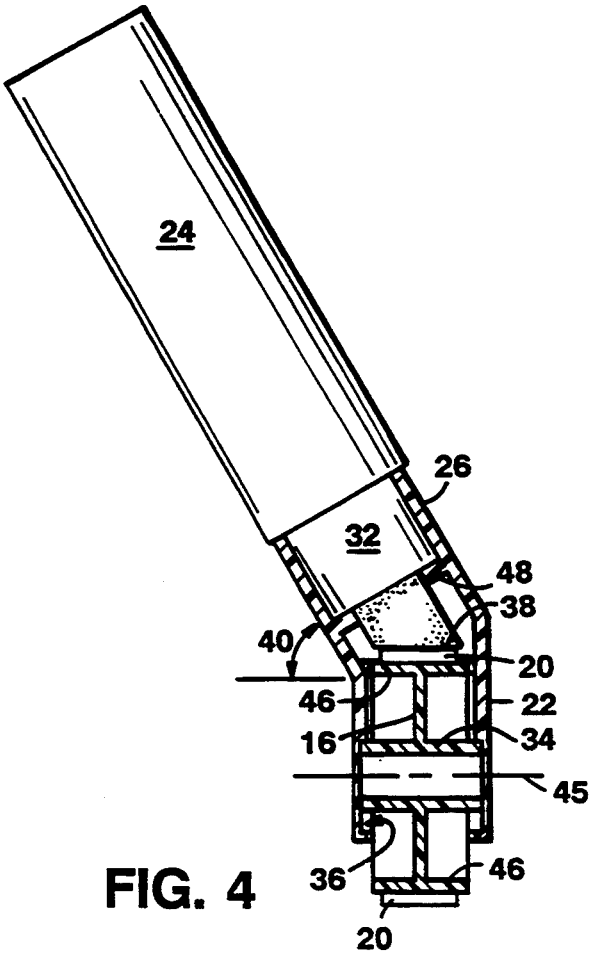
FIGS. 4 and 5 are side and end cutaway views of the roller stamp with a marker.
Figure 5:
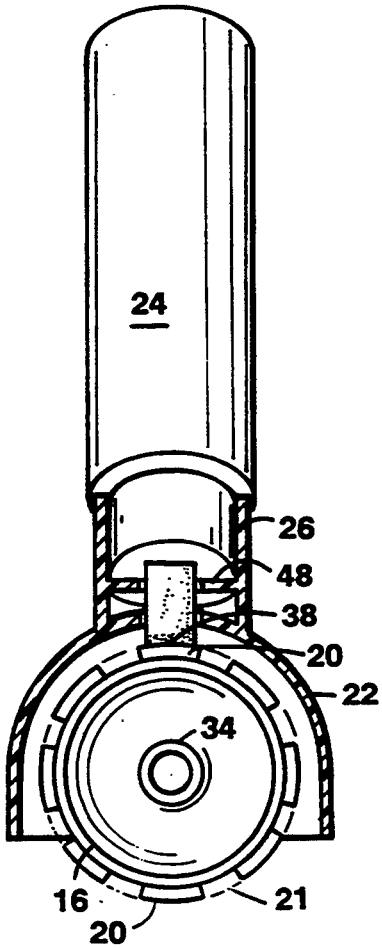

Referring to FIGS. 4 and 5, sleeve 26 is configured to hold the marking surface 38 of the marker in contact with the printing surface 20. The sleeve is canted out of the plane of the wheel by an angle that is the complement of the nib angle 40 of the marker. To assure that the full width of the printing surface will be inked by the marking surface 38 of the nib, the broad dimension 43 of the nib is held parallel to the axis 45 of the wheel 16 by a guideway 48 described below. Note that the printing surface defines a circle 21 concentric with the rim 16 of the wheel, and the marking surface 38 of the nib lies in a plane tangent to that circle. The sleeve 26 has an inner diameter marginally smaller than the outer diameter of capping crown 32 of the marker, so the marker is held in the sleeve by a friction fit. The housing and sleeve are molded from polypropylene or polyethylene, plastics with good friction characteristics relative to the outer surface of the marker body and good fatigue resistance. The sleeve wall thickness is 0.040" to 0.060", thin enough to elastically deform slightly as the marker is inserted, yet thick enough for durability and for the resilience of the wall to exert the necessary gripping force. The sleeve will retain its characteristics through many duty cycles as markers are removed and replaced, as the markers run out of ink or as the user desires to change colors.

Referring to FIGS. 6, 7, and 8, guideway 48 of sleeve 26 has a rectangular opening 50. This guideway is perpendicular to the axis of the sleeve, and provides a rectangular slot slightly larger than the major 42 and minor 44 dimensions of the marker nib. The semicylindrical housing has a corresponding slot 52, roughly of dimensions equal to the minor dimension 44 and the broad dimension 43 of the nib. The slots in the guideway and housing serve both to guide the insertion of the marker into the correct orientation and to hold the nib against the dislodging force exerted as the wheel is turned against it.

Referring to FIG. 9, alternatively the sleeve could be of inner diameter somewhat larger than the diameter of the capping crown of the marker. The inner surface of the sleeve would be lined with crush ribs 54 to grip the capping crown.

Referring again to FIGS. 4 and 5, the rim 46 of wheel 16 provides a base for the printing surface. The printing surface spans the broad dimension 43 of the marking surface 38 of the marker. The flange also serves as a friction bearing to stabilize the wheel in the housing. The housing 22 contacts somewhat more than 180 degrees of the rim to hold the wheel securely in the correct orientation. The wheel is also molded of polypropylene or polyethylene.

The wheel 16 is molded with an axle 34 projecting through it, and the housing is molded with cavities 36 for accepting the axle and thereby holding the wheel. The cavities are oval shaped, allowing the wheel to slide up and down in the housing. As hand pressure is exerted to impress the printing surface to the paper, the wheel slides up on its axle in the oval cavities until the printing surface is held against the nib. The oval cavities allow the position of the wheel to self-adjust to maintain the proper contact between the printing surface and the nib, thereby compensating for variability in the positioning of the marker in the sleeve, dimensions of the nib, nib wear, or diameter of the printing surface.

Referring to FIGS. 10 and 11, the repeating pattern can be any lettering or graphic design. A graphic pattern can be used for craft decoration, decorating personal stationery, or to add a whimsical note to school notes or reports, e.g. the footprints 80 of FIG. 10. An advantage of the roller stamp over other stamps is that the pattern of the printing surface can be arranged to "meet itself." This allows a roller stamp of finite circumference (81) to print a seamlessly repeating graphic of length limited only by the bounds of the surface and the ink supply. The roller stamp can be used in an office for labelling or identification, e.g., marking packages "Fragile" or "Priority Mail" 82 as in the example of FIG. 11, especially where it is desirable to ensure readability by repeating the message several times.

A complex graphic may require that the wheel and printing surface be molded in a multi-part mold.

Referring to FIG. 12, the housing may be configured to snap seal to a cap 83, providing an airtight seal to protect the marker from drying out.

The roller stamp could be sold in a kit with multiple interchangeable wheels, each with a different printing surface.

Alternately, as shown in FIG. 13, each wheel can be mounted permanently in its own housing, and the kit of rollers held in a special molded plastic tray 84. (Only one roller stamp is shown in FIG. 13.) The tray provides a recessed storage place 86 for each of the wheel/-housing units 88 with a marker mounted in the sleeve. A snap seal between the opening of the housing and the case protects the markers against drying out; thus the marker can be stored mounted in the roller stamp, ready for instant use without uncapping. A recess 90 can be provided to hold an extra marker. The tray could be permanently affixed to a work surface via double-sided tape or screws.

Other embodiments are within the scope of the claims.

For example, the wheel could also be a disk, rather than the relieved-sided molding depicted in FIGS. 4, 5, 14, and 15.

Referring to FIGS. 14 and 15, the marker can be mounted with the major dimension 42 of the nib 30 in the plane of the wheel 16. In this embodiment, all forces will lie in the plane of the wheel, thus providing somewhat better control of the stamp at the cost of a narrower printing surface.

Referring to FIG. 16, a marker with a square nib (where nib angle 40 is 90°) would allow a simplified housing construction by eliminating the angle of the sleeve on the housing.

Referring to FIG. 17, the geometry of the nib can be modified to improve the performance of the roller stamp. A narrower minor dimension 44 would allow some flex and "wiping," improving the inking of the roller.

Referring to FIGS. 18 and 19, the capping crown of the marker could be manufactured with a ferrule providing a reverse curve feature 70. The sleeve of the housing could be molded with several projecting ribs mating to the reverse curve feature 72. This would securely lock the marker into a precise location relative to the housing.

Referring to FIG. 20, the housing 22 could be configured to provide a refillable ink reservoir 64 instead of the sleeve to hold a marker. Or, as in FIG. 21, the housing could be configured to screw onto an ink refill bottle 68. The ink could be transferred from the reservoir to the front of the printing surface by a sponge, pad, or brush 66. Alternatively, the ink could be applied to the back of the substrate, and would flow to the printing surface through a microporous substrate and printing surface.

Referring to FIG. 22, the wheel could be molded with a compliant foam layer between the rigid hub 46 of the wheel and the printing surface 20. Or, as in FIG. 23, the wheel could be molded with compliant spokes 76, or from a flexible plastic. These features would allow some float to take up the tolerance between the nib and the printing surface, in the manner of the oval cavities 36 of FIG. 7.

Referring to FIG. 24, multiple sleeves 26 could be used to hold several markers 24, allowing the printing of a wider graphic.

Referring to FIG. 25, the printing surface could lie on a flexible belt 60, and the belt could be mounted on two or more rollers 62 in the housing. The length of the repeating pattern could be doubled by using a Möbius belt.

What is claimed is:

1. A hand-held stamp for printing on a surface, the stamp comprising an endless substrate having a raised printing surface, and a mechanism for allowing said substrate to rotate as said printing surface is rolled across said surface and said printing surface is simultaneously inked from two or more porous-point markers held to ink a printing surface wider then the nib of one of said markers.

2. The stamp of claim 1 wherein said substrate comprises a wheel, said wheel allowed to move within said stamp so as to maintain inking contact between said printing surface and said marker.

3. The stamp of claim 1 wherein said substrate comprises a flexible belt.

4. A hand-held roller stamp comprising a wheel having a raised printing surface, a housing holding said wheel and permitting said wheel to rotate, said housing being configured to hold a porous-point marker having a nib positioned to continuously ink said printing surface, said marker having a capping crown, said housing comprising a sleeve to hold said capping crown, and a cap configured to mate to said stamp to provide an airtight seal of said marker.

5. A hand-held roller stamp comprising a wheel having a raised printing surface, a housing holding said wheel and permitting said wheel to rotate, said housing being configured to hold a porous-point marker having a nib positioned to continuously ink said printing surface, said marker having a capping crown, said housing comprising a sleeve to hold said capping crown, and a case to hold said stamp, said case configured to mate to said stamp to provide an airtight seal of said marker.

6. A hand-held roller stamp comprising a wheel having a raised printing surface, and a housing holding said wheel and permitting said wheel to rotate, said housing being configured to hold a porous-point marker having a nib positioned to continuously ink said printing surface, said marker having a capping crown, said housing comprising a sleeve to hold said capping crown, said sleeve comprising crush ribs projecting from an inner surface of said sleeve.

7. The stamp of claim 6 wherein an outer surface of said capping crown and an inner surface of said sleeve comprise mating contours for interlocking said capping crown to said sleeve.

8. The stamp of claim 6 wherein said nib comprises a marking surface with a broad dimension and a narrow dimension, said marker being held with said broad dimension parallel to a rotational axis of said wheel.

9. The stamp of claim 8 wherein said marking surface lies in a plane tangent to a circle defined by said printing surface.

10. The stamp of claim 6 wherein said housing further comprises a guideway having a slot configured to position said nib.

11. The stamp of claim 10 wherein said slot has a cross section no more than slightly larger than said nib.

12. The stamp of claim 6 wherein said wheel has an axle having two ends, and said housing further comprises cavities to retain the ends of the axle of said wheel, said cavities being configured to allow said wheel to move toward or away from said nib.

13. The stamp of claim 6, 8, 10, or 12 wherein said wheel comprises a rim, said rim comprising an edge wherein said housing covers at least half of said rim.

14. The stamp of claim 6, 8, 10, or 12 wherein said printing surface is configured to print a self-meeting repeating graphic.

15. The stamp of claim 8, 10, or 12 further comprising a cap configured to mate to said stamp to provide an airtight seal of said marker.

16. The stamp of claim 8, 10, or 12 further comprising a case to hold said stamp to provide an airtight seal of said marker.

17. The stamp of claim 6 wherein said nib comprises a marking surface having a broad dimension, said sleeve supporting a guideway, said guideway having a slot having a cross section no more than slightly larger than said nib, said guideway being configured to hold said nib with said broad dimension parallel to a rotational axis of said wheel and said marking surface lying in a plane tangent to a circle defined by said printing surface.

18. The stamp of claim 6 wherein said printing surface comprises an endless substrate or endless belt, and said stamp further comprises a mechanism for allowing said substrate to rotate as said printing surface is rolled across said surface while said printing surface is simultaneously inked from said porous point marker, said nib being held by a guideway with a broad dimension of a marking surface of said nib parallel to a rotational axis of said wheel or belt.

19. A hand-held roller stamp comprising a wheel having a raised printing surface, and a housing holding said wheel and permitting said wheel to rotate, said housing being configured to hold a porous-point marker having a nib comprising a marking surface with a broad dimension and a narrow dimension, said marker being held with said broad dimension parallel to a rotational axis of said wheel.

20. The stamp of claim 19 wherein said marking surface lies in a plane tangent to a circle defined by said printing surface.

21. A hand-held roller stamp for transferring ink to a surface comprising a wheel having a raised printing surface and an axle having two ends, and a housing holding said wheel and permitting said wheel to rotate, said housing being configured to hold a porous-point marker having a nib positioned to continuously ink said printing surface, said housing comprises cavities to retain the ends of the axle of said wheel, said cavities being configured to allow said wheel to move toward or away from said nib while ink is being transferred to said surface.

22. The stamp of claim 19 or 21 wherein said printing surface is configured to print a self-meeting repeating graphic.

* * * * *